US009689252B2

(12) United States Patent
Ringgenberg

(10) Patent No.: US 9,689,252 B2
(45) Date of Patent: Jun. 27, 2017

(54) AUTONOMOUS PAINTED JOINT SIMULATOR AND METHOD TO REDUCE THE TIME REQUIRED TO CONDUCT A SUBSEA DUMMY RUN

(71) Applicant: Halliburton Energy Services, Inc., Houston, TX (US)

(72) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 18 days.

(21) Appl. No.: 14/438,570

(22) PCT Filed: Dec. 27, 2012

(86) PCT No.: PCT/US2012/071795

§ 371 (c)(1),
(2) Date: Apr. 24, 2015

(87) PCT Pub. No.: WO2014/105022

PCT Pub. Date: Jul. 3, 2014

(65) Prior Publication Data

US 2015/0275653 A1 Oct. 1, 2015

(51) Int. Cl.

| | |
|---|---|
| ***E21B 33/06*** | (2006.01) |
| ***E21B 33/064*** | (2006.01) |
| ***E21B 47/09*** | (2012.01) |
| ***E21B 34/04*** | (2006.01) |

(52) U.S. Cl.

CPC ..... *E21B 47/09* (2013.01); *E21B 33/062* (2013.01); *E21B 33/064* (2013.01); *E21B 34/045* (2013.01)

(58) Field of Classification Search

CPC .... E21B 33/062; E21B 33/064; E21B 34/045; E21B 47/09

See application file for complete search history.

(56) References Cited

U.S. PATENT DOCUMENTS 3,664,415 A * 5/1972 Wray ..... E21B 49/081 166/162
3,937,278 A * 2/1976 Sheshtawy ..... E21B 23/00 166/53
4,090,395 A * 5/1978 Dixon ..... E21B 47/1025 166/250.08

(Continued)

OTHER PUBLICATIONS

International Search Report and The Written Opinion of the International Searching Authority, or the Declaration, Sep. 4, 2013, PCT/US2012/071795, 15 pages, ISA/KR.

*Primary Examiner* — Matthew R Buck
(74) *Attorney, Agent, or Firm* — Haynes and Boone, LLP

(57) ABSTRACT

A system and method utilizing a painted joint simulator to reduce the time required to conduct a dummy run in order to space out subsea test equipment within a blow-out preventer. In certain embodiments, a heavy weight fluid is injected into a chamber of the joint in order to assist in its downhole descent speed. In other embodiment, a high pressure fluid is injected into a second chamber of the joint in order to force the heavy weight fluid out of the joint in order to assists in the assent back to the surface. Other embodiments include an umbrella assembly that assists in the descent or assent of the painted joint.

26 Claims, 7 Drawing Sheets

(56) References Cited

U.S. PATENT DOCUMENTS

| | | | | |
|---|---|---|---|---|
| 4,554,976 | A * | 11/1985 | Hynes | E21B 17/06 166/337 |
| 5,287,879 | A | 2/1994 | Leggett et al. | |
| 5,484,022 | A * | 1/1996 | Coutts | E21B 34/102 166/324 |
| 6,026,905 | A | 2/2000 | Garcia-Soule | |
| 6,454,011 | B1 * | 9/2002 | Schempf | E21B 4/18 166/335 |
| 6,675,888 | B2 * | 1/2004 | Schempf | E21B 4/18 166/153 |
| 7,062,960 | B2 * | 6/2006 | Couren | E21B 33/061 73/152.51 |
| 7,274,989 | B2 * | 9/2007 | Hopper | E21B 41/00 166/255.1 |
| 2009/0260829 | A1 | 10/2009 | Mathis | |

* cited by examiner

AUTONOMOUS PAINTED JOINT SIMULATOR AND METHOD TO REDUCE THE TIME REQUIRED TO CONDUCT A SUBSEA DUMMY RUN

The present application is a U.S. National Stage patent application of International Patent Application No. PCT/US2012/071795, filed on Dec. 27, 2012, the benefit of which is claimed and the disclosure of which is incorporated herein by reference in its entirety.

FIELD OF THE INVENTION

The present invention relates generally to subsea operations and, more specifically, to assemblies and methods utilizing a painted joint simulator to reduce the time required to conduct a dummy run in order to space out subsea test equipment within a blow-out preventer ("BOP").

BACKGROUND

During conventional drilling procedures, it is often desirable to conduct various tests of the wellbore and drill string while the drill string is still in the wellbore. These tests are commonly referred to as drill stem tests ("DST"). To facilitate DST, a subsea test tree ("SSTT") carried by the drill string is positioned within the BOP stack. The SSTT is provided with one or more valves that permit the wellbore to be isolated as desired, for the performance of DST. The SSTT also permits the drill string below the SSTT to be disconnected at the seabed, without interfering with the function of the BOP. In this regard, the SSTT serves as a contingency in the event of an emergency that requires disconnection of the drillstring in the wellbore from the surface, such as in the event of severe weather or malfunction of a dynamic positioning system. As such, the SSTT includes a decoupling mechanism to unlatch the portion of the drill string in the wellbore from the drill string above the wellbore. Thereafter, the surface vessel and riser can decouple from the BOP and move to safety. Finally, the SSTT typically is deployed in conjunction with a fluted hanger disposed to land at the top of the wellbore to at least partially support the lower portion of the drillstring during DST.

Before DST, however, proper positioning of the SSTT within the BOP is important so as to prevent the SSTT from interfering with operation of the BOP. In particular, if the SSTT is not correctly spaced apart from the hanger, proper functioning of the BOP rams may be inhibited. Moreover, the SSTT may be destroyed by the rams to the extent the rams are activated for a particular reason. Accordingly, a "dummy run" is conducted before DST to determine positioning of the SSTT within the BOP, and in particular the spacing of the fluted hanger from the SSTT so that the SSTT components are positioned between the BOP rams.

During conventional dummy runs, a temporary hanger with a painted pipe above it is run into the BOP, typically on jointed tubing. Once the temporary hanger lands within the BOP, the rams are closed on the painted pipe with sufficient pressure to leave marks that indicate their position relative to the landed hanger. The rams are then retracted, and the dummy string is retrieved uphole. Based upon the markings on the painted pipe, proper positioning of the SSTT within the BOP is determined and the spacing of the fluted hanger from the SSTT is accordingly adjusted at the surface to achieve the desired positioning when the SSTT is deployed in the BOP.

Although simplistic, there is at least one severe drawback to conventional dummy run operations. Making up the jointed tubing used in the dummy assembly is very time consuming. Given this, and the fact that some wells are drilled at ocean depths of up to 10,000 feet or deeper, it can take days to complete a single dummy run. At the present time, it is estimated that some floating rigs have a daily cost of upwards of 400,000 USD. Therefore, conventional dummy run operations are very expensive.

In view of the foregoing, there is a need in the art for cost-effective approaches to proper positioning of the subsea test equipment within the BOP.

DESCRIPTION OF ILLUSTRATIVE EMBODIMENTS

Illustrative embodiments and related methodologies of the present invention are described below as they might be employed in assemblies and methods for reducing the time required to conduct dummy runs through utilization of an autonomous painted joint simulator. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1A:
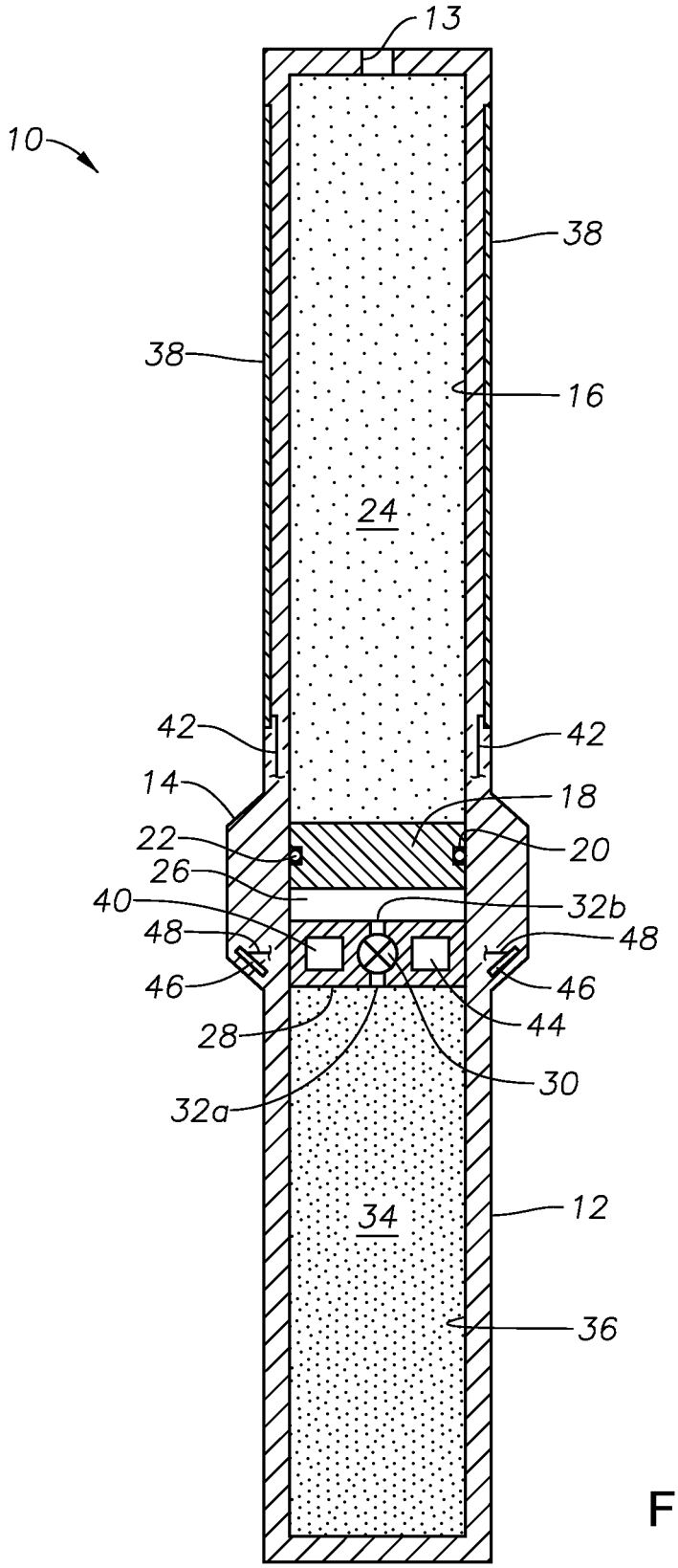
FIG. 1A is a cross-sectional view of an assembly to reduce the time associated with performing a dummy run according to certain exemplary embodiments of the present invention.

FIG. 1A illustrates an exemplary embodiment of assembly 10 utilized to reduce the time associated with conducting a dummy run according to exemplary embodiments of the present invention. Although not shown in FIG. 1A, assembly 10 is deployed down through a tubular (a riser, for example) that extends down through a body of water from a surface vessel, and is connected to a BOP (now shown). Assembly 10 includes a sensing joint 12 having a hanger 14 positioned along its body. Sensing joint 12 may be comprised of a buoyant material, aluminum or some other material suitable for downhole use. The outer diameter of sensing joint 12 matches the diameter of the real pipe that will be utilized during DST. In certain exemplary embodiments, hanger 14 may be a separate fluted hanger attached to the body of sensing joint 12. However, in other embodiments, hanger 14 may form part of sensing joint 12, as will be understood by those ordinarily skilled in the art having the benefit of this disclosure.

In certain exemplary embodiments, a first chamber 16 is formed within the upper end of sensing joint 12 in order to house a heavy weight fluid 24. An exit port 13 is positioned within the body of sensing joint 12 above first chamber 16. Heavy weight fluid 24 is "heavy" in that it is heavier, or more dense, than the fluid existing in the tubular (riser, for example) in which assembly 10 is deployed. Exemplary heavy weight fluids may include, for example, cesium formate, zinc bromide or calcium bromide. As shown, the upper end and side wall of first chamber 16 is formed by the body of sensing joint 16, while the bottom of chamber 16 is formed by a piston 18. In this exemplary embodiment, sensing joint 12 is a tubular shaped joint so that piston 18 comprises a mating disc-like shape. Piston 18 comprises a groove 20 extending around its side wall, wherein a seal 22 (o-ring seal, for example) is positioned. Seal 22 provides a seal against leakage of heavy weight fluid 24 around piston 18.

A valve assembly 28 is positioned beneath piston 18. As such, a piston chamber 26 is formed between piston 18 and valve assembly 28. In addition, a second chamber 36 is positioned below valve assembly 28 to house a high pressure fluid 34 utilized to force heavy weight fluid 24 out of sensing joint 12, as will be described herein. Exemplary high pressure fluids include liquids or gases, such as, for example, nitrogen or carbon dioxide, as will be understood by those ordinarily skilled in the art having the benefit of this disclosure.

Valve assembly 28 includes a valve 30 having communication ports 32*a* and 32*b* below and above it, respectively. In certain exemplary embodiments, valve 30 is, for example, an electric solenoid, rotary valve or needle valve. In other embodiments, valve 30 may also be a one-way operation valve such as, for example, a rupture disk that is punctured by a point, a eutectic material that is melted by a heating element or a rupture disk that is perforated. Communication port 32*a* communicates with second chamber 36, while communication port 32*b* communicates with piston chamber 26. As described in certain embodiments herein, valve 30 may be actuated to allow fluid communication between second chamber 36 and piston chamber 26, thereby allowing high pressure fluid 34 to bleed through communication ports 32*a,b* and force piston 18 upwardly, thus forcing heavy weight fluid 24 out of first chamber 16 via exit port 13.

Still referring to the exemplary embodiment of FIG. 1A, sensing joint 12 is a tubular member having a length sufficient to extend from the upper most ram to the lower most ram of a BOP. However, a shorter sensing joint may also be utilized. Sensing joint 12 includes a distributed ram sensing module 38 which extends along the length of sensing joint 12 above hanger 14. A CPU 40, along with necessary processing/storage/communication circuitry, forms part of valve assembly 28 and is coupled to ram sensing module 38, via lines 42, in order to process ram detect signals and communicate that data back uphole and/or to other assembly components via transmitter 44. In the alternative, however, CPU 40 may be located at some other location on sensing joint 12, as would be understood by one ordinarily skilled in the art having the benefit of this disclosure. Transmitter 44 communicates with a remote location (surface, for example) using, for example, acoustic, pressure pulse, or electromagnetic methodologies, as will be understood by those ordinarily skilled in the art having the benefit of this disclosure.

In this exemplary embodiment, ram sensing module 38 is integrated into the body of sensing joint 12. In the alternative, however, ram sensing module 38 may be positioned along the side walls of first chamber 16, or some other desired location, as will be understood by those ordinarily skilled in the art having the benefit of this disclosure. As will be described below, when one or more BOP rams come into contact with, or close proximity to, sensing joint 12, ram sensing module 38 senses the presence, retraction and/or location of each of the individual BOP ram. Ram sensing module 38 then produces a detect signal accordingly and transmits it to CPU 40, which then utilizes the corresponding detect signal or retract signal to perform further operations of assembly 10, as will be described below.

In certain exemplary embodiments, hanger 14 also comprises landing sensor modules 46 positioned herein. In the alternative, landing sensing modules 46 may also be positioned along the surface of hanger 14. Sensor modules 46 may be a variety of sensors, such as, for example, a proximity sensor or micro-switch, as will be understood by those ordinarily skilled in the art having the benefit of this disclosure. Landing sensor modules 46 are coupled to CPU 40 via one or more lines 48. As described herein, landing sensor modules 46 detect when hanger 14 has landed within the landing mechanism (wear bushing, for example), and then produce a detect signal that is transmitted to CPU 40 accordingly. Thereafter, as will be described herein, CPU 40 performs further operations of assembly 10 accordingly.

A variety of sensors and sensing methodologies may be utilized in conjunction with ram sensing modules 38 and landing sensor modules 46, as will be understood by one ordinarily skilled in the art having the benefit of this disclosure. The sensors could take the form of an acoustic (sonic or ultrasonic), capacitance, thermal, pressure, vibration, density, magnetic, inductive, dielectric, visual, nuclear or some other suitable sensor. Instead of the distributed sensing module described herein, however, one or more sensors may be individually placed along sensing joint 24. As such, in a most simplistic approach, ram sensing modules 38 and landing sensor modules 46 may simply detect that a BOP ram has contacted, or come into close proximity to, sensing joint 12. Yet, in a more sophisticated embodiment, ram sensing modules 38 may also detect the location of each individual BOP ram along sensing joint 12.

In other alternative exemplary embodiments, landing sensor modules 46 may be a suitable accelerometer which detects when assembly 10 has stopped moving. In such embodiments, an accelerometer may be suitable given that assembly 10 may encounter obstructions during deployment which produce false landing signals when certain non-accelerometer sensors are utilized.

In yet another alternative embodiment, assembly 10 does not contain second chamber 36, piston 18 or valve assembly 28. Instead, assembly 10 only includes first chamber 16 which extends the length of joint 12. The top of chamber 16 will be open and an exit valve will be located at the bottom of chamber 16. As such, the exit valve may be opened when desired, and the hydrostatic difference between heavy weight fluid 24 and the lighter weight fluid outside assembly 10 will cause heavy weight fluid 24 to drain out the exit valve. Those ordinarily skilled in the art having the benefit of this disclosure realize that this and other variations of assembly 10 are within the scope of the present invention.

In yet another exemplary embodiment, a slow burning explosive may be used to generate high pressure fluid 34 in order to drive out heavy weight fluid 24. The slow burning explosive will be contained in second chamber 36, and valve 30 would not be utilized. An exemplary slow burning explosive may be, for example, those as utilized in a Baker 10 or Baker 20 setting tool, as would be readily understood in the art. A check valve will be installed at exit port 13 in order to prevent first chamber 16 from refilling with annular fluids once the hot gas cools.

Figure 1B:
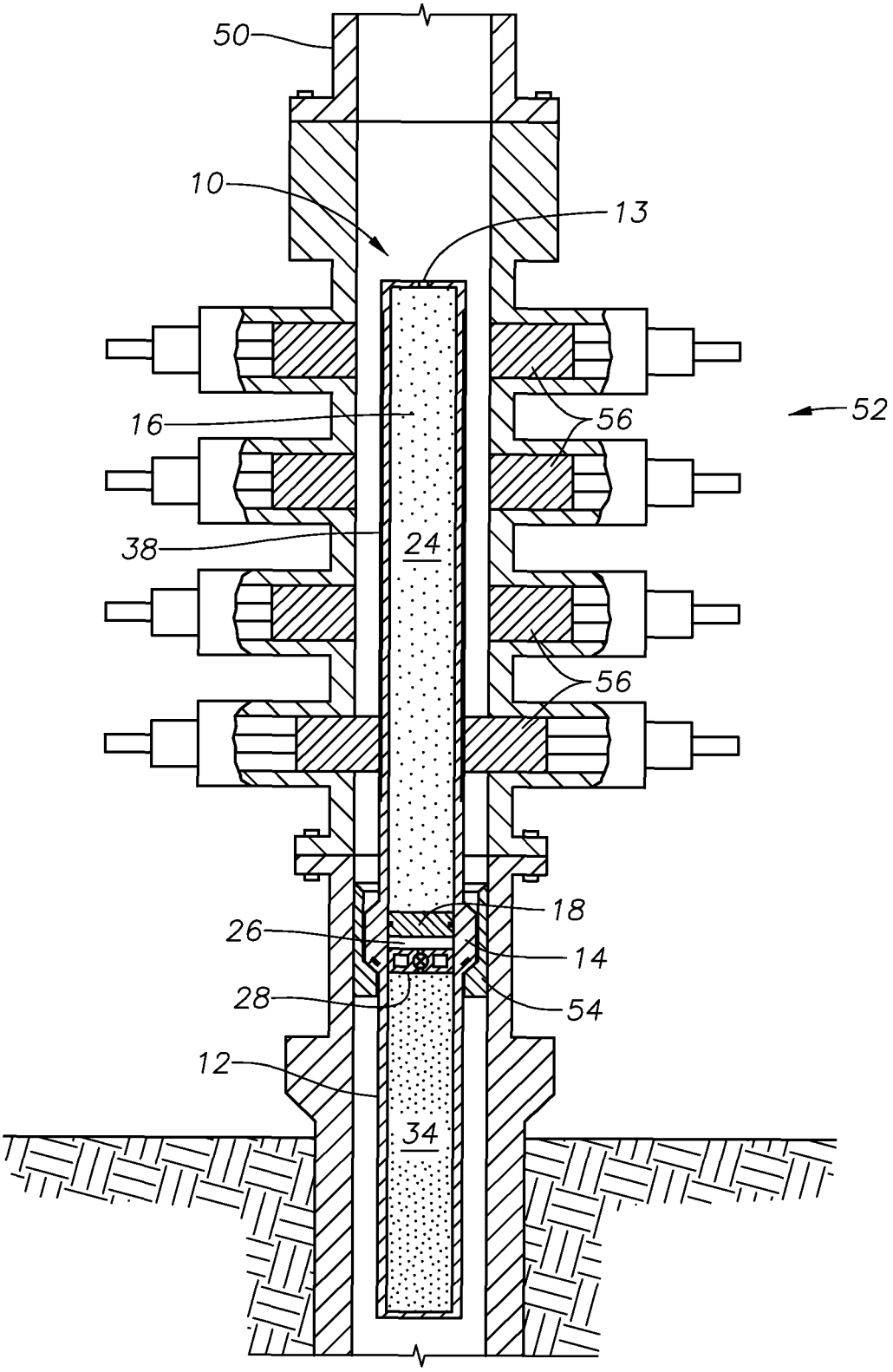
FIG. 1B illustrates the assembly of FIG. 1A landed within a BOP with the lowermost ram closed.
Figure 1C:
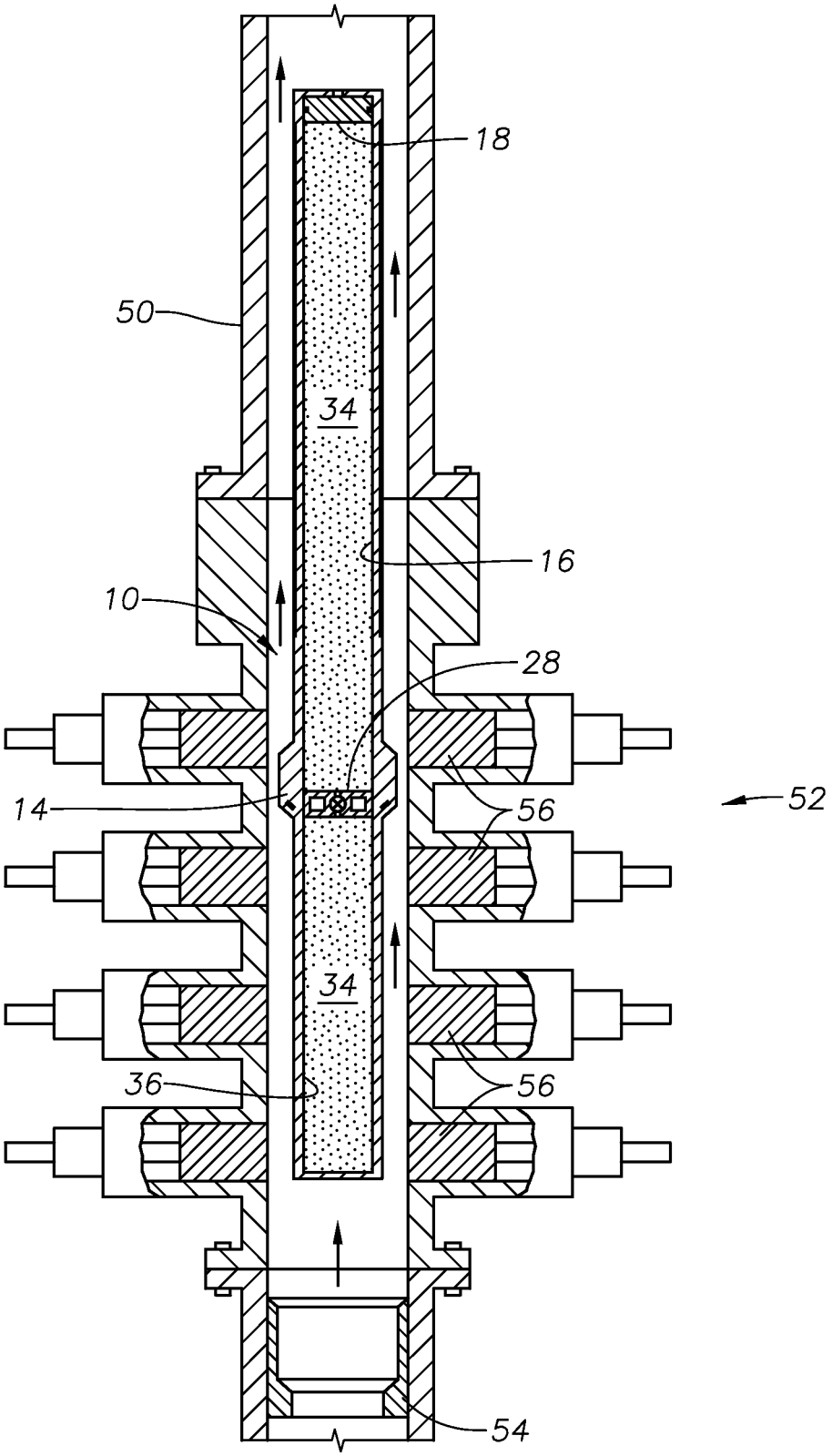
FIG. 1C illustrates the assembly of FIG. 1A during its assent back to the surface in accordance to certain exemplary methodologies of the present invention.

With reference to FIGS. 1A-1C, an exemplary method to determine placement of a SSTT within a BOP using assembly 10 will now be described, in accordance to one or more exemplary methodologies of the present invention. In this embodiment, sensor joint 12 is a painted joint. When it is desired to conduct a dummy run, first chamber 16 is filled with heavy weight fluid 24 and second chamber 36 is filled with high pressure fluid 34 (high pressure gas, for example) using a small valve and filling port, as will be understood by those ordinarily skilled in the art having a benefit of this disclosure. Thereafter, assembly 10 is then deployed down riser 50 (FIG. 1B) from a surface vessel (not shown). In certain embodiments, assembly 10 is simply dropped down riser 50. Note that riser 50 already contains a downhole fluid less dense than heavy weight fluid. Accordingly, the weight of heavy weight fluid 24 in assembly 10 will work to increase the descent speed of assembly 10 downward without the need to pump fluid downhole. However, in certain embodiments, fluid may be pump downwardly to assist assembly 10 with its downward descent.

Assembly 10 continues its downward descent into BOP 52 until hanger 14 lands within the landing mechanism (i.e., wear bushing 54) adjacent BOP 52, as shown in FIG. 1B. Once landed, landing sensor modules 46 detect that hanger 14 has seated within wear bushing and transmits a respective detect signal to CPU 40. CPU 40 then, in turn, instructs transmitter 44 to transmit a signal to the surface to close one or more BOP rams 56 upon sensing joint 12. In this embodiment, only the lowermost BOP ram 56 is closed around sensing joint 12 (FIG. 1B). Once closed, ram sensing module 38 senses that one or more of BOP rams 56 have closed thereon and, in turn, transmits a detect signal to CPU 40 accordingly.

CPU may then, via transmitter 44, transmit a signal to the surface indicating BOP ram(s) 56 are closed upon sensing joint 12. As such, the force by which BOP rams 56 close upon sensing joint 12 may be monitored such that the assembly is not damaged. However, BOP ram(s) 56 will close upon sensing joint 12 with sufficient force to place of mark on the painted outer surface, thereby providing a visual indication of the position of the BOP ram(s) 56 which will ultimately be utilized to determine the desired, or proper, placement of the SSTT (not shown) within the BOP 52. However, in other embodiments, BOP ram(s) 56 may be pre-calibrated to only apply the force needed to place the mark on the painted surface; in such embodiments, there is no need to transmit the detect signal when BOP ram(s) 56 are closed upon sensing joint 12.

Nevertheless, the one or more after BOP ram(s) 56 are then retracted from sensing joint 12. Ram sensing modules 38 then detect the retraction and transmit a retract signal to CPU 40. In certain exemplary embodiments, CPU 40 then initiates a timer to countdown to a defined time period (5 minutes, for example) whereby valve 30 is opened once the time expires. However, in other embodiments, CPU 40 may open valve 30 immediately after receiving the retract signal. In yet another embodiment, a valve open signal may be transmitted from the surface to open valve 30. Nevertheless, once valve 30 is opened in either embodiment, high pressure fluid 34 is allowed to flow into piston chamber 26 via communication ports 32*a,b*. As high pressure fluid 34 continues to flow into piston chamber 26, the pressure builds inside piston chamber 26 such that piston 18 is forced up first chamber 16, thus forcing heavy weight fluid 24 out of exit port 13 (FIG. 1C). Thereafter, high pressure fluid 34 fills first chamber 16 and second chamber 34, as seals 22 of piston 18 prevent high pressure fluid from escaping sensing joint 12. As a result, heavy weight fluid 24 has been replaced with lightweight gas, thus providing buoyancy such that assembly 10 can float in the tubular. Accordingly, in response to the detected retraction of one or more BOP rams 56, piston 18 is actuated to force heavy weight fluid 24 out of sensing joint 12.

Referring to FIG. 1C, once all or a sufficient amount of heavy weight fluid 24 have been ejected from first chamber 16, the air pressure within assembly 10 is higher than the pressure of the surrounding downhole fluids within riser 50 and BOP 52. Moreover, since the high pressure fluid 34 is lighter than the fluids outside assembly 10, a buoyant "submarine" effect occurs, whereby the higher air pressure weight of assembly 10 forces it to move back up through riser 50 back towards the surface. However, in an alternate methodology, fluid may also be pumped uphole to assist in the upward assent of assembly 10. Nevertheless, once assembly 10 arrives at the surface, it is removed and visually inspected for the mark indicator on its painted exterior created by the closed BOP ram(s) 56. Thereafter, correct placement of the SSTT within BOP 52 is determined based upon the mark that indicates the position of the BOP ram(s) 56. Moreover, if ram sensing modules 38 are distributed sensors, CPU 40 may also store where BOP rams 56 squeezed joint 12. In such embodiments, this data may be used to more precisely determine the position of each BOP ram 56.

In certain exemplary embodiments, one or more accelerometers (or similar components) may be included in assembly 10 to vent some of high pressure fluid 34 as assembly 10 assents back up riser 50. In such embodiments, an appropriate vent port will be included along first chamber 16 to vent the fluid pressure outside assembly 10. As a result, in addition to the decreasing relative pressure between the inside and outside of assembly 10, the accelerometers and vent port may be utilized to decrease the assent speed of assembly 10 as it nears the surface, as will be appreciated by those ordinarily skilled in the art having the benefit of this disclosure. Moreover, a surface catcher may be utilized to control the retrieval of assembly 10, as will also be appreciated by those same skilled persons.

Still referring to FIGS. 1A-1C, in another alternative embodiment as previously described, assembly 10 may not contain second chamber 36, piston 18 or valve assembly 28. Instead, assembly 10 only includes first chamber 16 which extends the length of joint 12. The top of chamber 16 will be open and an exit valve will be located at the bottom of chamber 16. In such embodiments, once assembly 10 has landed and the lowermost BOP ram 56 retracted, CPU 40 will receive the retract signal as previously described and, as a result, open a lower exit valve. Heavy weight fluid 24 then drains out of the lower exit valve and chamber 16 then refills via the opened top with the lighter fluids outside assembly 10. Given its buoyant nature, assembly 10 then begins to move uphole.

In another alternative embodiment utilizing a single chamber, one or more ports could open and simply allow heavy weight fluid 24 to flow out and be replaced by lighter well fluid. In such embodiments, joint 12 would be made of a buoyant material such that, once heavy weight fluid 24 has drained out, joint 12 would float back up to the surface.

Figure 2A:
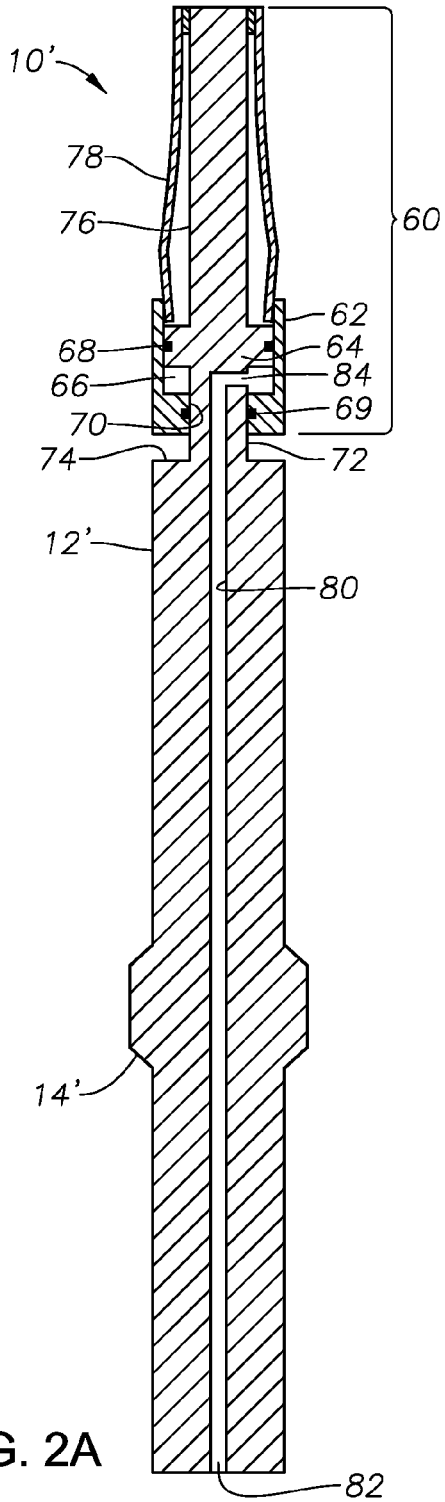
FIG. 2A is a cross-sectional view of an alternate assembly to reduce the time associated with performing a dummy run according to certain exemplary embodiments of the present invention.

FIG. 2A illustrates an alternate embodiment of the present invention utilized to reduce the time associated with conducting a dummy run, according to certain exemplary embodiments of the present invention. As with FIG. 1A, assembly 10' comprises a joint 12' having hanger 14' positioned thereon. However, unlike assembly 10, this exemplary embodiment of joint 12' includes no sensors. Instead, joint 12' is a solid body made of any appropriate material suitable for downhole use, as previously described. Also, at the upper end of joint 12' is an umbrella assembly 60. A portion of umbrella 60 forms part of the body of joint 12', as shown.

An L-shaped piston 62 is positioned over a T-shaped portion 64 of joint 12' that acts in conjunction with piston 62 to form piston chamber 66. A seal 68 (o-ring, for example) extends around the side walls of T-shaped portion 64 to seal the upper end of piston chamber 66. Another seal 69 (o-ring, for example) also extends around a bore 70 formed in piston 62 in order to seal around the lower end of piston chamber 66. As such, bore 70 allows piston 62 to slidingly move along a neck portion 72 of joint 12 during operation, as will be described below. A shoulder portion 74 is positioned along joint 12 at the base of neck portion 72 in order to provide a stop surface for piston 62.

A crown portion 76 of joint 12 extends up beyond piston 62 in like fashion to neck portion 72. An expandable umbrella body 78 such as, for example, a cement basket is coupled to the top of crown portion 76. As will be understood by those ordinarily skilled in the art having the benefit of this disclosure, expandable umbrella body 78 is biased in the open position. However, as shown in FIG. 2A, piston 62 is positioned such that expandable umbrella body 78 is retained in the closed positioned during deployment downhole. Although not shown, in certain embodiments, a shear pin, or similar device, may be positioned between piston 62 and T-shaped portion 64 such that piston 62 retains expandable umbrella body 78 is the closed positioned during downhole deployment. In such an embodiment, the shear pin may be rated at, for example, 500 psi or higher. However, those ordinarily skilled in the art will realize that other retaining mechanisms may also be utilized.

Figure 2B:
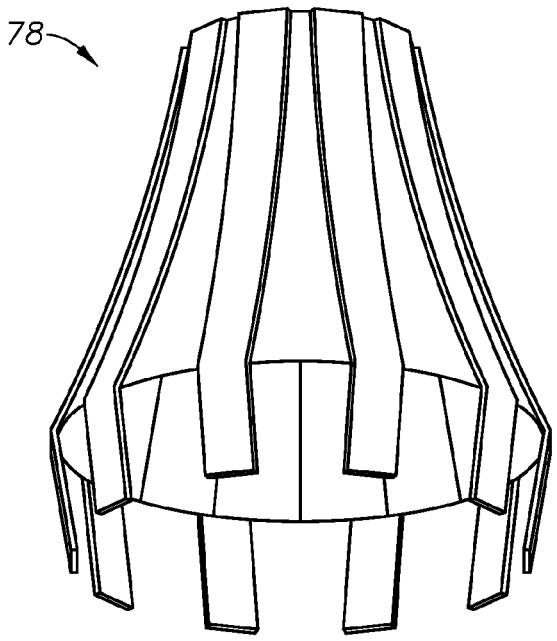
FIG. 2B illustrates a three-dimensional view of a cement basket utilized as the umbrella assembly according to certain exemplary embodiments of the present invention.

Still referring to FIG. 2A, a fluid communication port 80 extends from port opening 82 located at the bottom of assembly 10' to port opening 84 within piston chamber 66. Although port opening 82 is illustrated at the bottom of assembly 10', in other exemplary embodiments port opening 82 may be located elsewhere along a portion of joint 12' at a position beneath the location of the lowest BOP ram 36 that will subsequently close on joint 12, as will be described below. Thus, fluid communication port 80 thereby provides fluid communication between umbrella assembly 60 to a location outside joint 12' (via port opening 82). As will be described below, fluid may be communicated up through fluid communication port 80 and out into piston chamber 66 in order to force piston 62 downward into shoulder portion 74, thus releasing expandable umbrella body 78 to actuate into the open position (FIG. 2B illustrates a 3D view of expandable umbrella body 78 in the open position). Fluid may then be pump upwardly through riser 50 and into expandable umbrella body 78 in order to assist assembly 10' in its assent back to the surface.

In certain alternate exemplary embodiments, umbrella assembly 60 may be a packer assembly. Here, the packer assembly would be a loose fitting packer positioned around the upper portion of joint 12'. Therefore, as the fluid is pumped upwardly, it will encounter resistance underneath the loose fitting packer, thus forcing the assembly uphole as described herein. The operation of such a packer assembly will be readily understood by those ordinarily skilled in the art having the benefit of this disclosure.

Figure 2C:
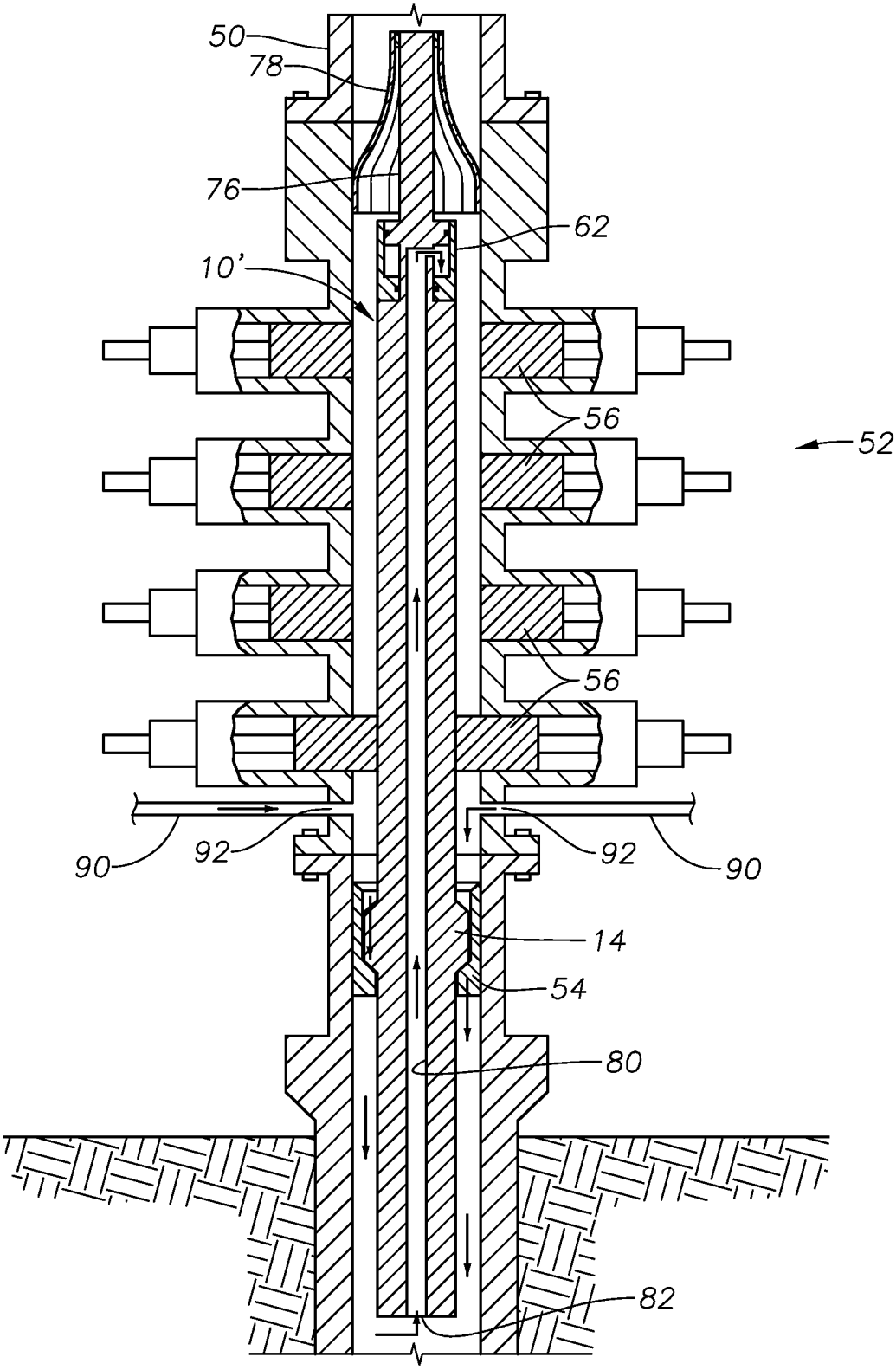
FIG. 2C illustrates the assembly of FIG. 2A and how the umbrella assembly is opened while the assembly is landed within a BOP with the lowermost ram closed.

With reference to FIGS. 2A-2D, an exemplary method to determine placement of a SSTT within a BOP using assembly 10' will now be described, in accordance to one or more exemplary methodologies of the present invention. After assembly 10' is assembled and umbrella assembly 60 locked in the closed positioned (using shear pins, for example), assembly 10' may be dropped from the surface into riser 50, as previously described herein. In this exemplary embodiment, the outer surface of joint 12' is painted. Assembly 10' continues its downward descent into BOP 52 until hanger 14 lands within the landing mechanism (i.e., wear bushing 54) adjacent BOP 52, as shown in FIG. 2C.

Thereafter, one or more BOP ram(s) 56 are closed upon joint 12' such that a mark is created on the outer painted surface of joint 12'. In this embodiment, one or more BOP rams 56 are closed after a certain period of time in which it expected for assembly 10' to arrive at BOP 52. In the alternative, sensitive listening device on riser 50 may also be utilized to detect when assembly 10' has landed, as known in the art. Nevertheless, in this example, the lowermost BOP ram 56 is closed; however, in other embodiments, one or more other BOP rams 56 may be closed upon joint 12'. While the lowermost BOP ram 56 is still closed upon joint 12', downhole fluid is pumped through choke/kill line 90, port 92 of BOP 52, and into the annulus underneath lowermost BOP ram 56. As a result, since lowermost BOP ram 56 is closed, the fluid is forced downward where it flows through holes positioned within hanger 14 and wear bushing 54, as understood in the art. Thereafter, the fluid flow (identified by the arrows) continues up into port opening 82, along fluid communication port 80, and out into piston chamber 66. As the pressure continues to build while the fluid is continually being pump via choke/kill lines 90, the shear pins (not shown) retaining piston 62 to T-shaped portion 64 shear, thus activating umbrella assembly 60 to release expandable umbrella body 78 into the open position (as shown in FIG. 2C).

Figure 2D:
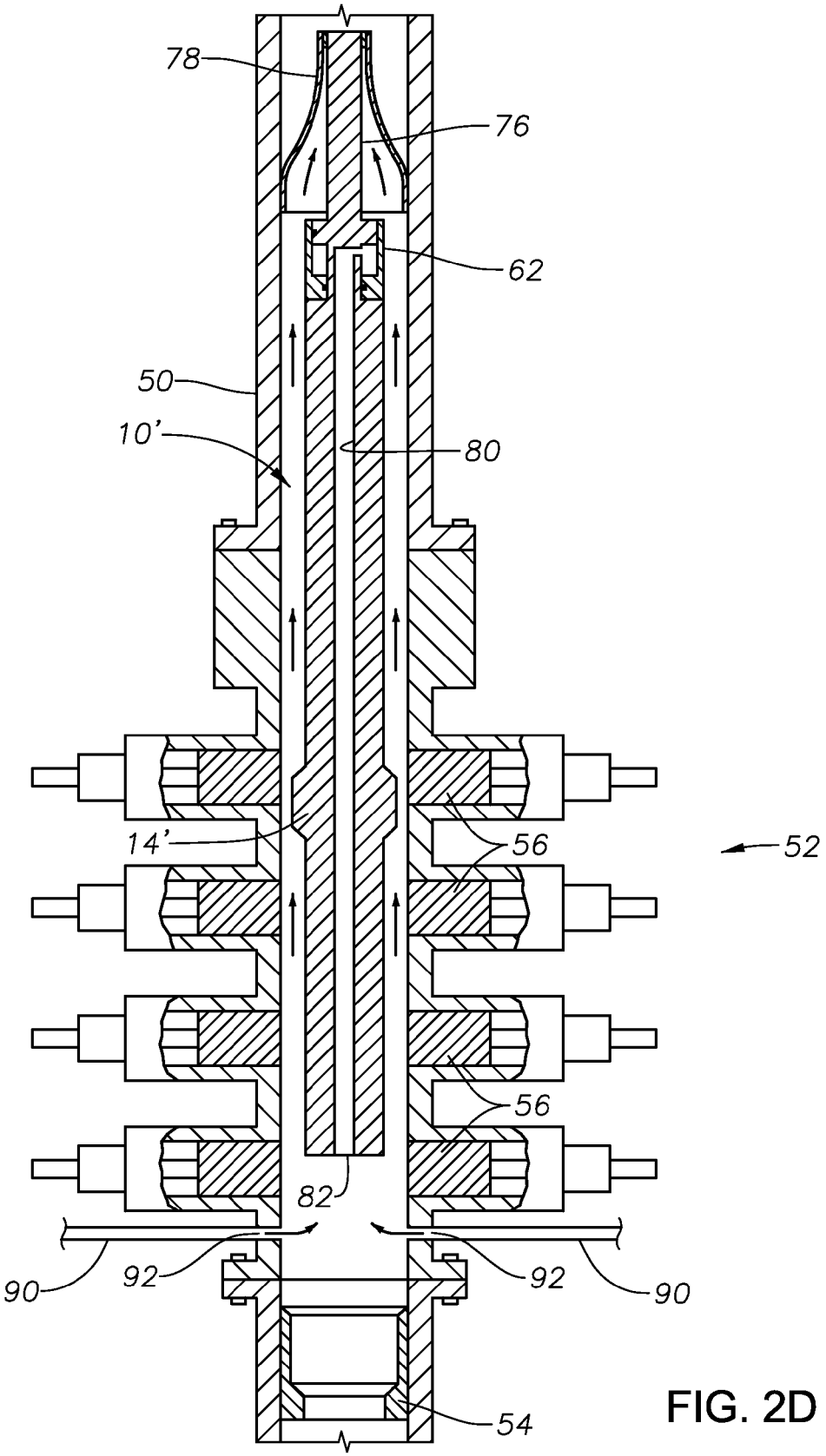
FIG. 2D illustrates the assembly of FIG. 2A during its assent back to the surface in accordance to certain exemplary methodologies of the present invention.

The lowermost BOP ram 56 is then retracted from joint 12'. Once retracted, fluid will continue to be pumped through choke/kill lines 90. As a result, as the fluid flows up riser 50, it acts to force joint 12' back up through riser 50 to the surface. In addition, since expandable umbrella body 78 is now in the open position, some of the upwardly moving fluid is caught underneath it to assist in the assent of assembly 10,' as shown in FIG. 2D. As pumping via choke/kill lines 90 continues, assembly 10' is eventually returned to the surface whereby the mark created by the closed BOP ram 56 is visually inspected in order to determine the desired placement of the SSTT within BOP 52, as will be understood by those ordinarily skilled in the art having the benefit of this disclosure.

Figure 3:
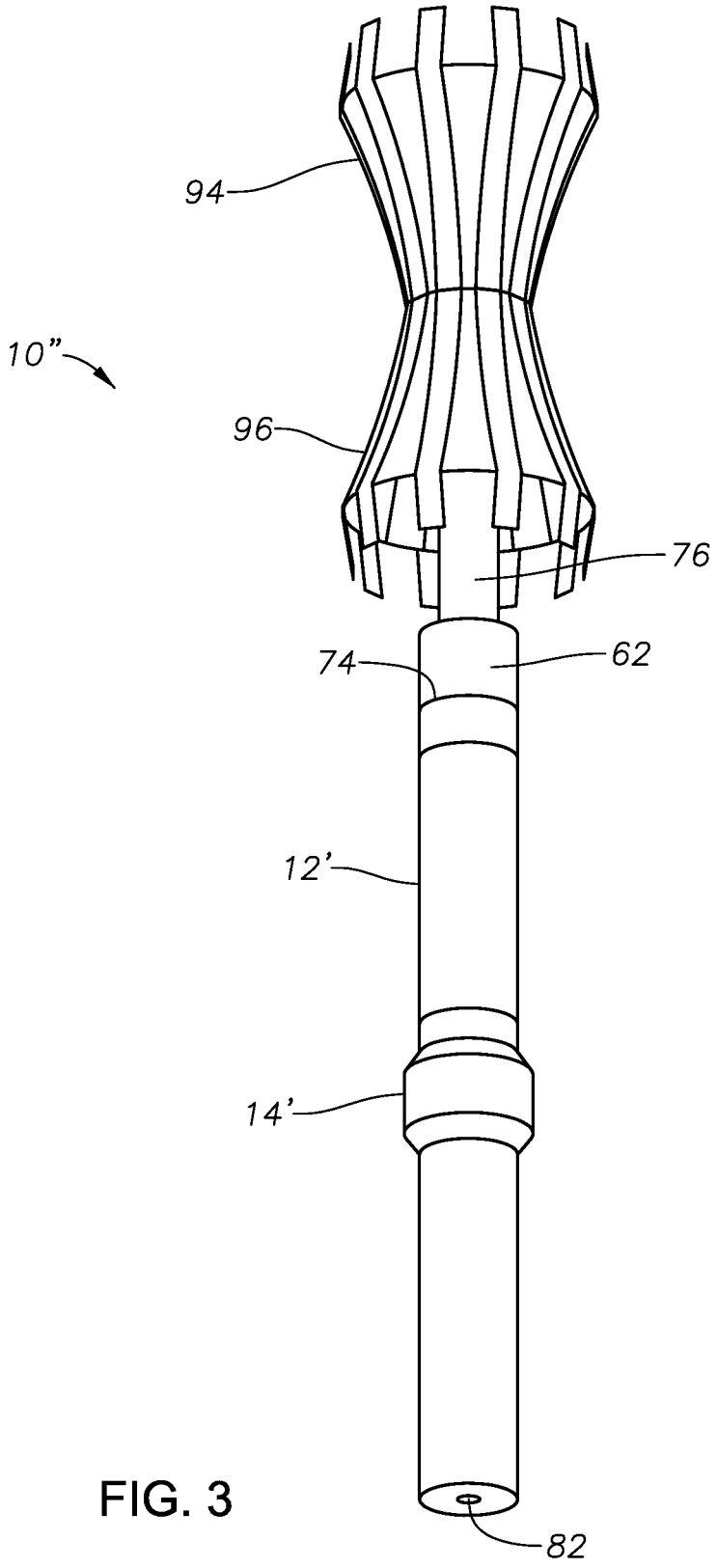
FIG. 3 illustrates a three-dimensional view of an assembly having a first and second umbrella assembly according to certain exemplary embodiments of the present invention.

Referring now to FIG. 3, yet another alternate embodiment of the present invention is illustrated as assembly 10". In this embodiment, joint 12" may be any of the joints described herein. However, the aspect intended to be highlighted in FIG. 3 is the use of a first umbrella assembly 96 and a second umbrella assembly 94 coupled to the top of joint 12". As shown, umbrella assemblies 96,94 are cement baskets. Unlike previous embodiments, however, umbrella assemblies 96,94 both remain in the open position during descent and assent (there is no need for piston 62). Nevertheless, during deployment of assembly 10", second umbrella assembly 94 is utilized to assist in the descent speed. Fluid would be pumped down through riser 50 and into second umbrella assembly 94 whereby it would act to assist in the descent. Once landed out, there will be a slight pressure increase as the downward moving fluid attempts to bypass around second umbrella assembly 94, which may be utilized to provide a clear indication at the surface that assembly 10" has landed. Thereafter, marks will be made on the painted exterior as previously described. Once BOP rams 56 have been retracted, fluid is pumped uphole whereby first umbrella assembly 96 is used to assist in the assent.

Various features of the present invention described herein may be combined as desired. For example, the single and double-chambered embodiments of assembly 10 may be combined with the umbrella assembly 60. In another embodiment, the dual umbrella feature of assembly 10" may be used in conjunction with assemblies 10 or 10'. Yet, in other embodiments, the packer assembly may be utilized as the umbrella assembly as described herein. These and other combinations of various features of the present invention will be readily apparent to those ordinarily skilled in the art having the benefit of this disclosure.

An exemplary methodology of the present invention provides a method to determine placement of an SSTT within a BOP, the method comprising deploying a sensing joint down through a tubular and into a BOP, the sensing joint comprising a heavy weight fluid contained therein; and a hanger positioned along the sensing joint; landing the sensing joint adjacent the BOP using the hanger; closing at least one BOP ram upon the sensing joint, thereby providing an indication of a position of the at least one BOP ram; retracting the at least one BOP ram from the sensing joint; forcing the heavy weight fluid out of the sensing joint; allowing the sensing joint to move back up through the tubular; and determining a desired placement of an SSTT within the BOP based upon the indication of the position of the at least one BOP ram. In another method, providing the indication of the position of the at least one BOP ram comprises placing a mark on the sensing joint using the at least one BOP ram, and wherein determining the desired placement of the SSTT comprises conducting a visual inspection of the mark. In yet another, closing the at least one BOP ram upon the sensing joint further comprises utilizing a sensor along the sensing joint to detect that the hanger has seated within a landing mechanism.

In another method, forcing the heavy weight fluid out of the sensing joint further comprises utilizing a high pressure fluid contained within the sensing joint to force the heavy weight fluid out of the sensing joint. In yet another, forcing the heavy weight fluid out of the sensing joint further comprises detecting retraction of the at least one BOP ram from the sensing joint; and in response to the detecting, actuating a piston positioned within the sensing joint to force the heavy weight fluid out of the sensing joint. In another, actuating the piston further comprises actuating a valve contained within the sensing joint to an open position to allow a high pressure fluid contained within the sensing joint to force the piston to expel the heavy weight fluid out of the sensing joint. In yet another, allowing the sensing joint to move back up through the tubular further comprises opening an umbrella assembly positioned at an upper end of the sensing joint and forcing fluid up the tubular and into the umbrella assembly. In another, opening the umbrella assembly further comprises activating a packer element.

An exemplary embodiment of the present invention provides an assembly to determine placement of a SSTT within a BOP, the assembly comprising a sensing joint comprising a first chamber housing a heavy weight fluid and a piston configured to force the heavy weight fluid out of the sensing joint, and the assembly further comprising a hanger positioned along the sensing joint. In another embodiment, the hanger further comprises a sensor to detect when the hanger has seated in a landing mechanism. In yet another embodiment, the sensing joint further comprises a sensor to detect when a BOP ram has contacted the sensing joint. In another, the sensing joint further comprises a second chamber housing a high pressure fluid configured to actuate the piston. In yet another, the sensing joint further comprises a valve positioned between the second chamber and the piston. Another embodiment further comprises an umbrella assembly positioned at an upper end of the sensing joint. In yet another, the umbrella assembly is a cement basket or a packer assembly.

Yet another exemplary methodology of the present invention provides a method to determine placement of a SSTT within a BOP, the method comprising landing a joint within a tubular adjacent a BOP, the joint comprising a heavy weight fluid; closing at least one BOP ram upon the joint; retracting the at least one BOP ram from the joint; forcing the heavy weight fluid out of the joint; moving the joint back up through the tubular; and utilizing the joint to determine a desired placement of an SSTT within the BOP. In another, utilizing the joint to determine the desired placement of the SSTT further comprises inspecting a mark placed on the joint by the at least one BOP ram. In yet another, closing the at least one BOP ram upon the joint further comprises utilizing a sensor along the joint to detect that the joint has landed. In another, forcing the heavy weight fluid out of the joint further comprises utilizing a high pressure fluid to force the heavy weight fluid out of the joint. In yet another, moving the joint back up through the tubular further comprises activating an umbrella assembly positioned along the joint and forcing fluid up the tubular and into the umbrella assembly. In another, activating the umbrella assembly further comprises activating a packer element or opening a cement basket.

Yet another exemplary methodology of the present invention provides a method to determine placement of a SSTT within a BOP, the method comprising deploying a joint down through a tubular and into a BOP, the joint comprising a first umbrella assembly positioned at an upper end of the joint and a hanger positioned along the joint; landing the joint adjacent the BOP using the hanger; closing at least one BOP ram upon the joint, thereby providing an indication of a position of the at least one BOP ram; activating the first umbrella assembly; retracting the at least one BOP ram from the joint; causing fluid to flow up the tubular and into the activated first umbrella assembly; moving the joint back up through the tubular; and determining a desired placement of an SSTT within the BOP based upon the indication of the position of the at least one BOP ram. In another, providing the indication of the position of the at least one BOP ram comprises placing a mark on the joint using the at least one BOP ram, and wherein determining the desired placement of the SSTT comprises conducting a visual inspection of the mark.

In another exemplary method, activating the first umbrella assembly further comprises forcing fluid through a fluid communication port positioned within the joint, the fluid communication port providing fluid communication between a piston forming part of the first umbrella assembly and a location outside the joint, the piston configured to restrain the first umbrella assembly in a closed position; and utilizing the forced fluid to actuate the piston such that the piston releases the first umbrella assembly to an open position. In another, forcing fluid through the fluid communication port further comprises receiving the forced fluid from a location outside the joint that is beneath the closed at least one BOP ram In yet another, the first umbrella assembly is activated while the at least one BOP ram is closed upon the joint. In another, activating the first umbrella assembly further comprises activating a packer element or opening a cement basket. In yet another, deploying the joint down through the tubular further comprises utilizing a second umbrella assembly to assist in deploying the joint down through the tubular.

Yet another exemplary embodiment of the present invention provides an assembly to determine placement of a SSTT within a BOP, the assembly comprising a joint comprising a first umbrella assembly positioned at an upper end of the joint; and a fluid communication port providing fluid communication between the first umbrella assembly and a location outside the joint; and a hanger positioned along the joint. In another embodiment, the first umbrella assembly further comprises an expandable basket portion extending from the upper end of the joint; and a piston positioned to hold the basket portion in a closed position. In another, the fluid communication port is positioned to provide communication between the piston and the location outside the tool joint. In yet another, the location outside the tool joint is located beneath at least one BOP ram. In another, the first umbrella assembly is a cement basket or a packer assembly. In yet another, a second umbrella assembly is positioned above the first umbrella assembly.

Yet another exemplary methodology of the present invention provide a method to determine placement of a SSTT within a BOP, the method comprising landing a joint within a tubular adjacent a BOP, the joint comprising a first umbrella assembly; closing at least one BOP ram upon the joint; activating the first umbrella assembly; retracting the at least one BOP ram from the joint; moving the joint back up through the tubular; and utilizing the joint to determine a desired placement of an SSTT within the BOP. In another, utilizing the joint to determine the desired placement of the SSTT further comprises inspecting a mark placed on the joint by the at least one BOP ram. In yet another, activating the first umbrella assembly further comprises actuating a piston of the first umbrella assembly to release the first umbrella assembly into an open position. In another, the first umbrella assembly is activated while the at least one BOP ram is closed upon the joint. In yet another, activating the first umbrella assembly further comprises activating a packer element or opening a cement basket. In yet another, landing the joint within a tubular further comprises utilizing a second umbrella assembly to assist in deploying the joint down through the tubular.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A method to determine placement of a subsea test tree ("SSTT") within a blow out preventer ("BOP"), the method comprising:

deploying a sensing joint down through a tubular and into a BOP, the sensing joint comprising:

a heavy weight fluid contained therein; and a hanger positioned along the sensing joint;

landing the sensing joint adjacent the BOP using the hanger;

closing at least one BOP ram upon the sensing joint, thereby providing an indication of a position of the at least one BOP ram;

transmitting a signal indicating detection of contact between the at least one BOP ram and the sensing joint;

retracting the at least one BOP ram from the sensing joint;

forcing the heavy weight fluid out of the sensing joint;

allowing the sensing joint to move back up through the tubular; and determining a desired placement of an SSTT within the BOP based upon the indication of the position of the at least one BOP ram.

2. A method as defined in claim 1, wherein providing the indication of the position of the at least one BOP ram comprises placing a mark on the sensing joint using the at least one BOP ram, and wherein determining the desired placement of the SSTT comprises conducting a visual inspection of the mark.

3. A method as defined in claim 1, wherein closing the at least one BOP ram upon the sensing joint further comprises utilizing a sensor along the sensing joint to detect that the hanger has seated within a landing mechanism.

4. A method as defined in claim 1, wherein forcing the heavy weight fluid out of the sensing joint further comprises utilizing a high pressure fluid contained within the sensing joint to force the heavy weight fluid out of the sensing joint.

5. A method as defined in claim 1, wherein forcing the heavy weight fluid out of the sensing joint further comprises:

detecting retraction of the at least one BOP ram from the sensing joint; and in response to the detecting, actuating a piston positioned within the sensing joint to force the heavy weight fluid out of the sensing joint.

6. A method as defined in claim 5, wherein actuating the piston further comprises actuating a valve contained within the sensing joint to an open position to allow a high pressure fluid contained within the sensing joint to force the piston to expel the heavy weight fluid out of the sensing joint.

7. A method as defined in claim 1, wherein allowing the sensing joint to move back up through the tubular further comprises:

opening an umbrella assembly positioned at an upper end of the sensing joint; and forcing fluid up the tubular and into the umbrella assembly.

8. A method as defined in claim 7, wherein opening the umbrella assembly further comprises activating a packer element.

9. An assembly to determine placement of a subsea test tree ("SSTT") within a blow out preventer ("BOP"), the assembly comprising:

a sensing joint comprising:

a sensor to detect when a BOP ram has contacted the sensing joint;

a first chamber housing a heavy weight fluid; and a piston configured to force the heavy weight fluid out of the sensing joint; and a hanger positioned along the sensing joint.

10. An assembly as defined in claim 9, wherein the hanger further comprises a sensor to detect when the hanger has seated in a landing mechanism.

11. An assembly as defined in claim 9, wherein the sensing joint further comprises a second chamber housing a high pressure fluid configured to actuate the piston.

12. An assembly as defined in claim 11, wherein the sensing joint further comprises a valve positioned between the second chamber and the piston.

13. An assembly as defined in claim 9, further comprising an umbrella assembly positioned at an upper end of the sensing joint.

14. An assembly as defined in claim 13, wherein the umbrella assembly is a cement basket or a packer assembly.

15. An assembly as defined in claim 9, wherein the sensor is operable to transmit a signal indicating detection of contact between the BOP ram and the sensing joint.

16. A method to determine placement of a subsea test tree ("SSTT") within a blow out preventer ("BOP"), the method comprising:

landing a joint within a tubular adjacent a BOP, the joint comprising a heavy weight fluid;

closing at least one BOP ram upon the joint;

transmitting a signal indicating detection of contact between the at least one BOP ram and the joint;

retracting the at least one BOP ram from the joint;

forcing the heavy weight fluid out of the joint;

moving the joint back up through the tubular; and utilizing the joint to determine a desired placement of an SSTT within the BOP.

17. A method as defined in claim 16, wherein utilizing the joint to determine the desired placement of the SSTT further comprises inspecting a mark placed on the joint by the at least one BOP ram.

18. A method as defined in claim 16, wherein closing the at least one BOP ram upon the joint further comprises utilizing a sensor along the joint to detect that the joint has landed.

19. A method as defined in claim 16, wherein forcing the heavy weight fluid out of the joint further comprises utilizing a high pressure fluid to force the heavy weight fluid out of the joint.

20. A method as defined in claim 16, wherein moving the joint back up through the tubular further comprises:

activating an umbrella assembly positioned along the joint; and forcing fluid up the tubular and into the umbrella assembly.

21. A method as defined in claim 20, wherein activating the umbrella assembly further comprises activating a packer element or opening a cement basket.

22. A method to determine placement of a subsea test tree ("SSTT") within a blow out preventer ("BOP"), the method comprising:

landing a joint within a tubular adjacent a BOP, the joint comprising a first umbrella assembly;

closing at least one BOP ram upon the joint;

activating the first umbrella assembly by actuating a piston of the first umbrella assembly thereby releasing the first umbrella assembly into an open position;

retracting the at least one BOP ram from the joint;

moving the joint back up through the tubular; and utilizing the joint to determine a desired placement of an SSTT within the BOP.

23. A method as defined in claim 22, wherein utilizing the joint to determine the desired placement of the SSTT further comprises inspecting a mark placed on the joint by the at least one BOP ram.

24. A method as defined in claim 22, wherein the first umbrella assembly is activated while the at least one BOP ram is closed upon the joint.

25. A method as defined in claim 22, wherein activating the first umbrella assembly further comprises activating a packer element or opening a cement basket.

26. A method as defined in claim 22, wherein landing the joint within a tubular further comprises utilizing a second umbrella assembly to assist in deploying the joint down through the tubular.

* * * * *